US005647458A

United States Patent [19]

van der Sloot et al.

[11] Patent Number: 5,647,458

[45] Date of Patent: Jul. 15, 1997

[54] MAGNETIC RAIL BRAKE DEVICE

[75] Inventors: Bart van der Sloot, En Weidum; Hendrikus Johannes van Oostueen, He Maarssen, both of Netherlands

[73] Assignee: Transferia Systems B.V., Leeuwarden, Netherlands

[21] Appl. No.: 573,443

[22] Filed: Dec. 15, 1995

[30] Foreign Application Priority Data

Dec. 16, 1994 [NL] Netherlands ..... 9402145

[51] Int. Cl.[6] ..... B61H 7/12

[52] U.S. Cl. ..... 188/41; 188/165

[58] Field of Search ..... 188/41, 164, 165; 105/77, 78, 79

[56] References Cited

U.S. PATENT DOCUMENTS

| | | | |
|---|---|---|---|
| 3,768,607 | 10/1973 | Marzcocco | 188/165 |
| 4,480,727 | 11/1984 | Bergtsson et al. | 188/41 X |
| 4,715,486 | 12/1987 | Burgdorf et al. | 188/251 M X |
| 4,861,395 | 8/1989 | Miyasaka et al. | 148/321 |
| 5,018,605 | 5/1991 | Hooghiem et al. | 188/165 |
| 5,088,467 | 2/1992 | Mesenich | 123/531 |

FOREIGN PATENT DOCUMENTS

| | | |
|---|---|---|
| 2182434 | 12/1973 | France . |
| 2340470 | 2/1975 | Germany . |
| 3743899 | 5/1989 | Germany . |

OTHER PUBLICATIONS

Wegst, C. W. "Stahlschlussel", 1991, Verlag Stahlschlussel Wegst, Marbach 174450, pp. 346–347.

*Primary Examiner*—Lee W. Young

*Attorney, Agent, or Firm*—Merchant, Gould, Smith, Edell, Welter & Schmidt, P.A.

[57] ABSTRACT

A magnetic rail brake device comprising at least two wear pieces manufactured from ferromagnetic material, magnetically insulated from each other by a filling piece and connected to a magnet which, in operation, are capable of providing a magnetic field extending through the wear pieces. In operation, the wear pieces are contacted with a rail so as to enable the magnetic field to close through the rail, and at least at the location of the parts to be contacted with the rail, the wear pieces comprise wear strips manufactured from nodular cast iron, and at least on the side facing the rail, the filling piece is formed from austenitic cast iron.

2 Claims, 1 Drawing Sheet

MAGNETIC RAIL BRAKE DEVICE

FIELD OF THE INVENTION

The invention relates to a magnetic rail brake device comprising at least two wear pieces manufactured from ferromagnetic material, magnetically insulated from each other by means of a filling piece and connected to magnet means which, in operation, are capable of providing a magnetic field extending through the wear pieces, whilst, in operation, the wear pieces can be contacted with a rail so as to enable the magnetic field to close through the rail.

DESCRIPTION OF THE RELATED ART

Such devices are known both in an electromagnetic version and in a permanent magnetic version. A magnetic brake system is typically added to the main brake system of a train to increase the braking decelaration, if necessary. A magnetic brake system is also used as a parking brake. A magnetic brake system for rail vehicles usually comprises at least one brake shoe, suspended above a rail, mostly under a bogie between the wheels. The brake shoe comprises two wear strips of magnetizable material, extending parallel to each other in the same direction as the rail. When the wear strips are pressed on the head of a rail, magnetic lines of flux extending through the wear strips can close through the head of the rail. Accordingly, the wear strips are drawn against the rail by the magnetic field to produce an effective brake action. The wear strips are magnetically insulated from each other by an air gap extending between the wear strips, which air gap is usually filled with a filling strip of nonmagnetizable material. Such a rail brake device using permanent magnets is for instance described in Dutch patent application 8802279.

A problem occurring with both the electromagnetic and the permanent magnetic rail brake devices is the so-called plaque formation. Plaque formation arises through the fact that metal particles, coming off the head of the rail and/or the wear strips during braking, adhere to the wear strips, which, because of the good magnetic properties thereof, are conventionally manufactured from type 37 steel. By the magnetic forces, the metal particles are drawn against the wear strips and then caked, as it were, to the wear strips on account of the high temperature occurring during braking, which may for instance be 600 degrees C or more. In practice it has been observed that the thickness of a thus formed plaque of metal grindings may increase to approximately 10 mm. However, such a plaque of metal particles may form a short circuit for the magnetic field, as a consequence of which the wear pieces can no longer be drawn or are drawn to an insufficient extent against the rail. Thus, the braking force is strongly reduced. The consequences of the plaque formation can only be overcome through frequent maintenance.

Another problem occurring with the known magnetic brake systems is the non-optimum contribution to the brake action made by the filling strip, and the heat sensitivity thereof. As material for the filling strip, aluminum is often selected, but aluminum melts at 658 degrees C. Consequently, aluminum cannot provide any brake action at high temperatures. Another drawback of an aluminum filling strip is that it is relatively soft and wears quickly.

The object of the invention is to provide an improved magnetic rail brake device wherein the above-mentioned drawbacks do not occur or occur to a lesser extent. In general, the object of the invention is to provide an effectively operating rail brake device which couples a high braking power to a good working life.

To that end, according to the invention, a magnetic rail brake device of the above-described type is characterized in that at least at the location of the parts to be contacted with the rail, the wear pieces comprise wear strips manufactured from nodular cast iron, and that at least on the side facing the rail the filling piece is formed from nodular austenitic cast iron.

DETAILED DESCRIPTION OF THE ILLUSTRATED EMBODIMENT

Hereinafter, the invention will be further described with reference to the accompanying drawing.

Figure 1:
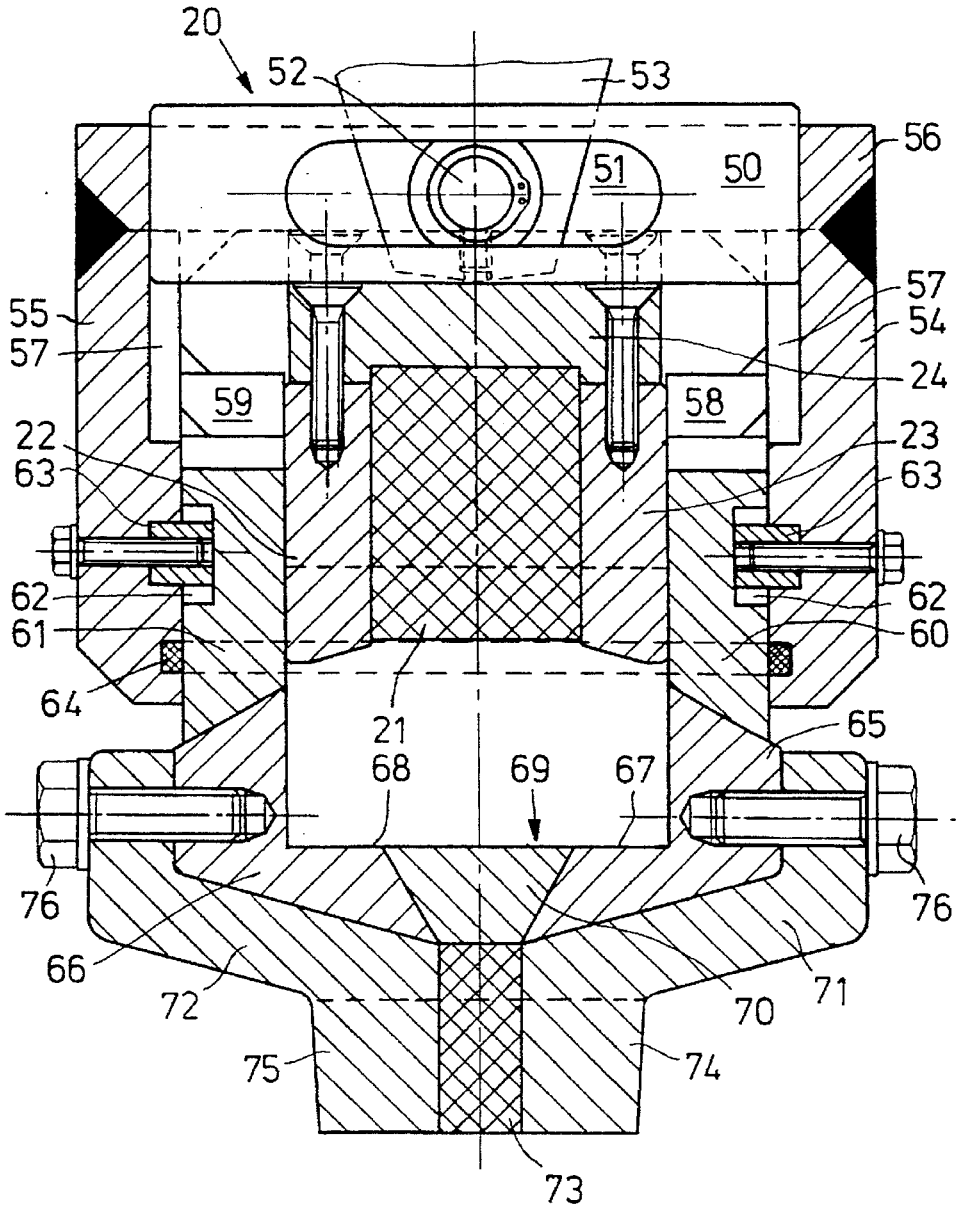
FIG. 1 illustrates the magnetic rail brake device according to the present invention.
Figure 1:
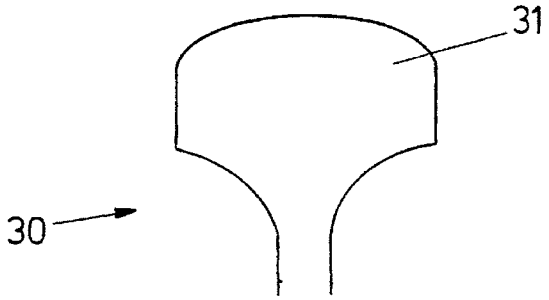

By way of example, FIG. 1 shows in vertical cross section a part of a magnetic rail brake device 20 of the permanent magnetic type described in Dutch patent application 8802279. The rail brake device is in the rest position at some distance above a rail 30, but can, if a brake action is required, be contacted with the head 31 of the rail by means not further shown.

FIG. 1 shows a permanent magnet 21, positioned between two pole plates 22,23. The pole plates are interconnected at their top sides by a fastening plate 24 of nonmagnetizable material, for instance aluminum or stainless steel or the like.

By means of a cross beam 50 and a hinge pin 52 extending through a slotted hole 51 into the cross beam, the plate 24 is connected to the bottom end 53 of an operating member, such as a hydraulic or pneumatic cylinder.

The cross beam 50 is capable of moving up and down between side plates 54,55 of an inverted U-shaped magneto body of magnetizable material such as type 37 steel. At the location of the cross beam, the top plate 56 of the magneto body is provided with an opening. For guiding the cross beam 50, vertical slots 57 are provided in the side plates.

The magnet is shown in the rest position. In that position, the top sides of the magnet 21 and of the pole plates 22,23 are at the level of two flanges 58,59 which extend inwards from the side plates of the magneto body and which function as pole shoes.

At some distance under the flanges 58,59, the facing surfaces of the side plates 54,55 abut against plates 60,61 of magnetically insulating material, such as for instance aluminum. In the position shown, the aluminum plates 60,61 partly abut against the pole plates of the magnet. The magnet has a pole face to the left and to the right. In this position, the lines of flux of the magnet can only close via the flanges 58,59, the side plates 54,55 and the top plate 56.

The plates 60,61 of magnetically insulating material are preferably fastened to the side plates 54,55 with some freedom of movement. For this purpose, in the example shown, a groove 62 provided in the outer wall of each of the plates 60,61 is utilized, into which groove one or more projections 63 extend which are fastened to the side plates 54,55 and which are narrower than the width of the groove. Further, a sealing member 64, recessed in the side plates, is used.

The plates 60,61 of magnetically insulating material extend to the free bottom edge of the side plates 54,55 and connect to pole shoes 65,66 of magnetizable material, such as type 37 steel. Spaced from the plates 60,61, the pole shoes have facing flanges 67,68 which leave clear a slot 69, in this example having the shape of an inverted trapezium and in this example filled with a magnetically insulating connecting piece 70.

The magnetically insulating plates 60,61, the pole shoes 65,66 and the connecting piece 70 together form a U-shaped housing which has its open end arranged in the inverted U-shaped magneto body and is capable of guiding the magnet 21 with the pole plates 22,23 in upward and downward movement.

Mounted on the outside are brake block parts 71,72, fitting against the pole shoes 65,66 and leaving clear an air gap filled by a magnetically insulating filling strip 73. The brake block parts 71,72 are manufactured from magnetizable material and preferably have downwardly extending flanges 74,75 which form wear strips on both sides of the gap. In this example, the brake block parts are mounted on the pole shoes by means of screw bolts 76.

If, by means of an operating member, the magneto body is contacted with a rail head and the magnet is slid between the plates 60,61 to abut against the flanges 67,68, the lines of flux can close via the pole shoes, the brake block parts and the head 31 of the rail 30, causing the wear strips and the filling strip to be forcibly drawn against the rail.

It is observed that in the example shown the wear strips form part of brake block parts that engage around the pole shoes 65,66. Many other constructional possibilities readily occur to a skilled person. For instance, the wear strips could be loose strips, detachably mounted on the rest of the brake block parts, or mounted directly on the pole shoes 65,66. The invention is not limited to devices having wear strips which have a specific shape and/or which are mounted in a specific manner.

Neither is the invention limited to brake devices of the construction shown in FIG. 1 or to brake devices having permanent magnets, or to permanent magnetic devices having magnets capable of moving up and down in a housing.

As observed hereinabove, the known magnetic rail brake devices involve the problem of plaque formation, which adversely affects the brake action and necessitates frequent maintenance, in particular the cleaning of the wear strips.

In accordance with the invention, the problem of plaque formation can be overcome at least to a considerable extent through the use of special wear strips, manufactured from a suitable type of cast iron. Tests have demonstrated that plaque formation hardly occurs, if at all, if nodular cast iron is used for the wear strips. Tests with cast iron of the type GGG40 did not reveal any plaque formation. Moreover, at speeds above 80 km/hour, wear strips of this material proved to have a higher friction coefficient than wear strips of type 37 steel.

As is indicated hereinabove, a filling strip of nonmagnetizable material is placed between the wear strips. The filling strip serves as a magnetic screen, preventing the magnetic lines of flux from avoiding the head of the rail. The filling strip also prevents metal parts from ending up between the wear strips.

In accordance with the invention, the action of the magnetic brake can be further improved if the filling strip is manufactured from a special material which is better resistant to a high temperature than the conventional filling strip material (aluminum) and which possibly provides a better brake action as well. Tests have demonstrated that austenitic cast iron is a suitable material, for instance nodular or lamellar austenitic cast iron. This material does not become magnetic and is resistant to the temperatures which occur during operation. A suitable material is for instance GGG-NiCr 20 2having material number 0.7660 according to DIN 1694, or a similar material.

Another advantage of the use of a filling strip of austenitic cast iron is that the resistance to wear of the brake device is substantially improved.

It is observed that after the foregoing, various constructional modifications of the example shown and described will readily occur to a skilled person. For instance, the filling strip could partly consist of austenitic cast iron, on the side facing the rail, and partly of a different, nonmagnetic material. Such modifications are understood to fall within the scope of the invention.

What is claimed is:

1. A magnetic rail brake device comprising at least two wear pieces manufactured from ferromagnetic material, magnetically insulated from each other by a filling piece and connected to magnet means which, in operation, are capable of providing a magnetic field extending through the wear pieces, whilst, in operation, the wear pieces can be contacted with a rail so as to enable the magnetic field to close through the rail, wherein the wear pieces have contacting portions contactable with the rail, the contacting portions comprising wear strips manufactured from nodular cast iron, and the filling piece has a side facing the rail formed from austenitic cast iron.

2. A magnetic rail brake device according to claim 1, wherein the filling piece is manufactured from material of the type GGG-NiCr 20 2, material number 0.7660 according to DIN 1694.

* * * * *

UNITED STATES PATENT AND TRADEMARK OFFICE
CERTIFICATE OF CORRECTION

PATENT NO. : 5,647,458

DATED : July 15, 1997

INVENTOR(S) : van der Sloot et al.

It is certified that error appears in the above-identified patent and that said Letters Patent is hereby corrected as shown below:

In column 4, line 40, claim 1, insert --at least one-- after the word "the".

In column 4, line 44, claim 2, insert --at least one-- after the word "the".

Signed and Sealed this

Third Day of March, 1998

*Attest:*

Bruce Lehman

BRUCE LEHMAN

*Attesting Officer*

*Commissioner of Patents and Trademarks*